US007377727B2

(12) United States Patent
Randlett et al.

(10) Patent No.: US 7,377,727 B2
(45) Date of Patent: May 27, 2008

(54) MINING ROOF SUPPORT CYLINDER CORROSION PROTECTION APPARATUS AND METHOD

(75) Inventors: Lawrence Alan Randlett, Fruitland, NM (US); Steven Frank Willard, Albuquerque, NM (US)

(73) Assignee: Avistar, Inc., Albuquerque, NM (US)

( * ) Notice: Subject to any disclaimer, the term of this patent is extended or adjusted under 35 U.S.C. 154(b) by 0 days.

(21) Appl. No.: 11/723,096

(22) Filed: Mar. 16, 2007

(65) Prior Publication Data

US 2007/0160428 A1 Jul. 12, 2007

Related U.S. Application Data

(62) Division of application No. 11/085,218, filed on Mar. 22, 2005, now abandoned.

(51) Int. Cl.
*E21D 23/00* (2006.01)

(52) U.S. Cl. ..... 405/290; 422/10

(58) Field of Classification Search ..... 405/288–302; 299/10–12; 422/9–10; 92/87
See application file for complete search history.

(56) References Cited

U.S. PATENT DOCUMENTS 4,557,808 A 12/1985 Strunck et al.
4,612,848 A 9/1986 Pollack
5,026,218 A 6/1991 Zimmerman
5,074,623 A 12/1991 Hedlund et al.
5,950,673 A 9/1999 Elliott-Moore
5,997,100 A 12/1999 Marshall et al.
6,551,552 B1 4/2003 Lyublinski et al.

FOREIGN PATENT DOCUMENTS

DE 3139046 4/1983
JP 62-287087 12/1987

*Primary Examiner*—Sunil Singh
(74) *Attorney, Agent, or Firm*—Oliff & Berridge, PLC

(57) ABSTRACT

A roof support for an underground mine which has a hydraulic cylinder positioned between a roof engaging support and a ground engaging base and has a flexible gas barrier or enclosure surrounding surfaces of said hydraulic cylinder which are subject to corrosion by gases present in the underground mine. Continuous flowing non-corrosive gas such as nitrogen is supplied to a space between the gas barrier and the hydraulic cylinder for preventing corrosion of cylinder surfaces by corrosive gases present in the mine which may include hydrogen sulfide.

10 Claims, 6 Drawing Sheets

MINING ROOF SUPPORT CYLINDER CORROSION PROTECTION APPARATUS AND METHOD

This is a Division of application Ser. No. 11/085,218 filed Mar. 22, 2005, now abandoned. The disclosure of the prior application is hereby incorporated by reference herein in its entirety.

BACKGROUND OF THE INVENTION

1. Field of the Invention

This invention relates to a corrosion protection system and a method of protecting certain articles from corrosion by enclosing the articles in a suitable enclosure and flushing the interior space of the enclosure with a continuous flow of non-corrosive gas, thereby preventing ambient corrosive gasses (or other corrosive agents) from contacting the protected articles.

This invention relates to movable, semi-permanent or temporary roof supports and cylinders used in coal mining or other underground mining. Movable, semi-permanent or temporary roof support apparatuses generally employ a roof engaging support and a ground-engaging base with hydraulic roof support cylinders positioned between a roof engaging support and a ground-engaging base. Hydraulic roof support cylinders are used in coal mining operations where gases or other agents, which are corrosive to cylinder exterior surfaces, may be present.

2. Description of Related Art

Temporary roof supports including temporary roof support cylinders as described in U.S. Pat. Nos. 5,950,673 and 5,026,218 are manufactured and sold by Joy MM Delaware Inc. The Joy roof support structure depends upon a hydraulic roof support cylinder which is plated with bronze and which is wiped infrequently by hydraulic fluids during use. As manufactured by Joy Mining Machinery, the roof support cylinders are coated with bronze for corrosion protection purposes. The cylinders may also be coated with other substitutions for bronze and brass. However, bronze was found in testing to be the best with Hydrogen sulfide. However, this material is corroded by at least hydrogen sulfide and, therefore, the cylinders require protection from prolonged contact with hydrogen sulfide gasses. During use, a roof support may be put in place with cylinders in an extended position, or only partially collapsed, thereby leaving at least some of its surfaces exposed for an extended period of time. This is especially true of semi-permanent roof supports as used in mining operations known as "longwall". When bronze or other copper containing surfaces are exposed to atmospheres which may include hydrogen sulfide with possible high humidity conditions, corrosion of the bronze or other plating becomes severe. When cylinders are severely corroded, the cylinder is no longer capable of operation because of leakage at hydraulic cylinder seals. Under certain mining conditions, as many as 35 percent of the cylinders used in a mine may require replacement within one year, resulting in possible replacement of 130 cylinders per year in one mining operation. The replacement or repair of each cylinder costs in the order of $40,000 for a cost of $5,000,000 per year.

In the art of mining where coal gob is present, nitrogen gas may also be supplied to the mine in order to decrease the danger of mine fires, or to provide rapid introduction of nitrogen in the case of emergency. "Gob" is collapsed roof strata, often containing coal that is left behind in a mine behind a longwall as it advances. Therefore, nitrogen, which is a known non-combustible and non-corrosive gas, is readily available in certain mining operations. Nitrogen is used to dilute methane and oxygen gases in a mine and is readily available as a gas which can be used to protect against corrosion. However, it is to be understood that any inert gas or gas which does not attack a hydraulic cylinder may be used such as clean air.

U.S. Pat. No. 6,551,552 to Lyublinski relates to corrosion protection and protecting an article from corrosion by placing an article in a gas impermeable enclosure. This prior art differs from Applicant's invention in that Applicant maintains open orifices and a small positive pressure within the gas enclosure which continually flushes the gas enclosure with the inserted non-corrosive gas (nitrogen). The '552 patent further fails to suggest or teach any possible utility for protection of bronze plated cylinders which are subject to corrosion by hydrogen sulfide gas in coal mines. '552 recognizes the corrosive nature of sulfides, and the susceptibility of copper, bronze and brass to certain corrosion under normal atmospheric conditions. As taught by '552 in column 3, the gas impermeable enclosure would have no tears, leaks or pinholes which would allow the higher internal pressure to equalize with the slightly lower external pressure. Applicant's invention, on the other hand, provides for continuous controlled flow and an orifice to the outside to control pressure on the inside.

BRIEF SUMMARY OF THE INVENTION

Observing the high cost associated with the need for replacement roof support cylinders in a mine where hydrogen sulfide or other corrosive gas is present, Applicant has conceived of the idea of use of the nitrogen gas available in the mine to shield bronze coated roof support cylinders from attack by hydrogen sulfide gas. Other cylinder metals and non-corrosive gases may also be used. The nitrogen, or other non-corrosive, gas is fed to a flexible plastic gas barrier which surrounds the roof support cylinder and which flows through the area surrounding the roof support cylinder. The nitrogen gas purges corrosive gas from the area of the roof support cylinders and leaves the roof support cylinder exposed only to the non-corrosive or nitrogen gasses. The gas barrier surrounding the roof support cylinders has a gas exit orifice, which maintains a slight positive pressure within the roof support cylinders enclosure.

For roof support cylinders, it is estimated that a complete replacement cost would be $40,000 per cylinder while repair costs would be in the order of $20,000 per cylinder. On the other hand, it is estimated that costs of approximately $1,000 per cylinder will be required to utilize the method and apparatus of this invention. This provides a substantial cost saving and it has not been recognized by those in the industry. The enclosure may be a rubber bellows bag or the like fastened and sealed to the cylinder at the top and bottom by hose clamps or any other clamping means.

The method of this invention applies to mining equipment used in certain underground coal mines. Currently exposed metal surfaces are subject to a corrosive environment by hydrogen sulfide gas and water spray mist. Corrosion has been especially severe on surfaces containing copper based alloys, such as bronze. Due to the corrosion, the life of certain parts of costly mining equipment is shortened significantly.

As a part of the mining process, nitrogen is introduced to suppress possible combustion of waste coal in mined out areas. This waste coal and roof strata, or gob, is present in areas that have been subjected to long wall mining operations. Air or oxygen, in the gob, can cause spontaneous combustion, therefore nitrogen is used to flush or dilute air and oxygen from the gob. The method of this invention can utilize the existing nitrogen supply system (or other non-corrosive gas supply) to create a non-corrosive environment immediately adjacent to corrosion sensitive metal surfaces. By flushing an enclosure with a continuous flow of non-corrosive gas, a non-corrosive environment is created, the protected metal surfaces and corrosive gases are prevented from contacting the surfaces, and the metal surfaces are protected.

The method of this invention prevents costly rebuilding and replacement of parts or the need for corrosion resistant alloys, and avoids the use of more costly corrosion protection methods using sacrificial barriers. The system is designed to be low cost and easily installed and removed for maintenance.

This invention incorporates an enclosure sized to completely cover articles to be protected. The enclosure(s) are provided with ports allowing gas introduction and gas exhaust from the interior of the enclosure. The enclosure need not be hermetically sealed or even tightly sealed, as the continuous flow of non-corrosive gas will flush away contaminating gases.

This invention comprises a roof support for an underground mine comprising in combination: a roof engaging support; a ground engaging base; at least one hydraulic cylinder positioned between said roof engaging support and said ground engaging base; a flexible gas barrier surrounding surfaces of said hydraulic cylinder which would otherwise be subject to corrosion by gases present in said underground mine; and non-corrosive gas supply for supplying a gas to a space between said gas barrier and said hydraulic cylinder, and wherein said gas is nitrogen or other suitable gas. The apparatus also has a pressure release orifice for creating a positive pressure within said gas barrier with respect to ambient pressure when non-corrosive gas is supplied to said space. This method also comprises a method for protection of exposed metal surfaces in a coal mine or other mines comprising the steps of: placing metallic parts in a coal mine having a corrosive gas; creating a non-corrosive environment immediately adjacent to corrosion sensitive metallic parts; placing said metallic parts in an enclosure; and introducing a flow of a non-corrosive gas into the enclosure; wherein said mine atmosphere includes hydrogen sulfide or other corrosive agents and said exposed metal surfaces contain a copper base alloy or other material subject to corrosion and wherein the non-corrosive gas is nitrogen or other non-corrosive gases. The enclosure can also be put on before items are placed in the mine.

DETAILED DESCRIPTION OF THE INVENTION

Figure 1:
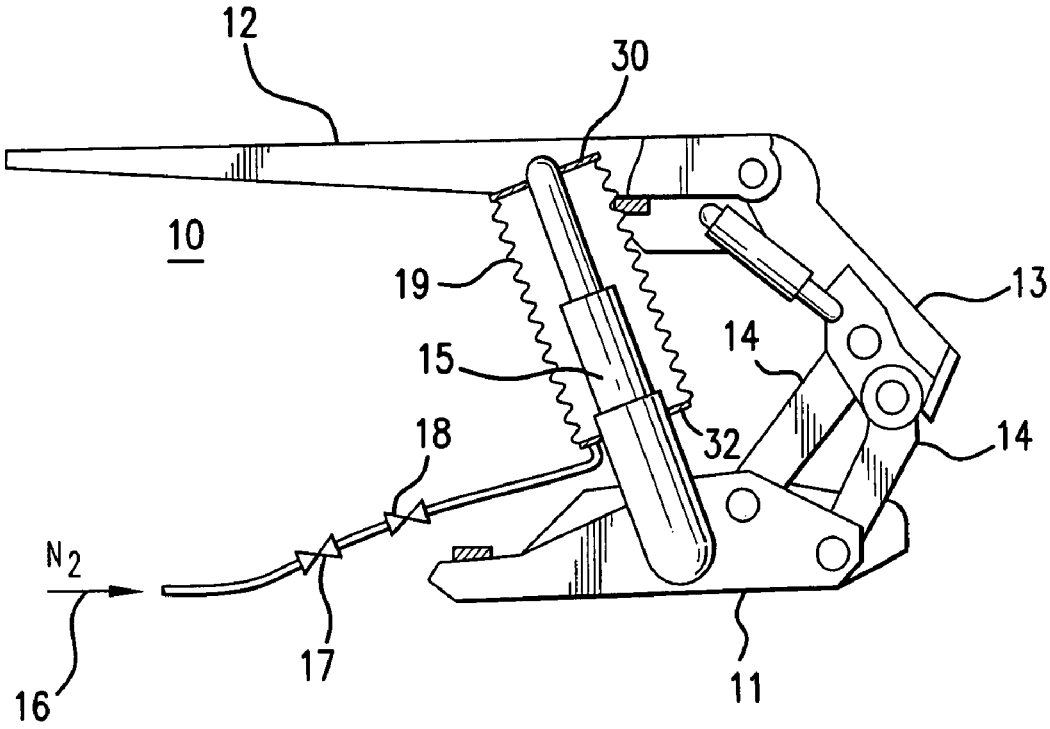
FIG. 1 shows a roof support cylinder and roof support which includes a gas barrier enclosure in accordance with this invention.
Figure 1A:
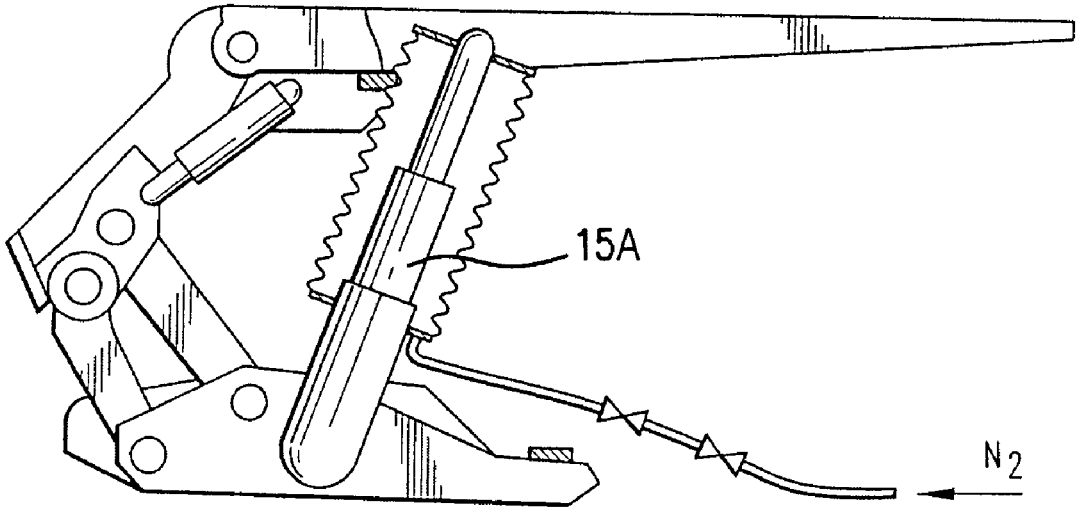
FIG. 1A shows the opposite side of FIG. 1 which depicts a second cylinder 15A.

In FIG. 1 there is shown a typical mine roof support 10. The support has a ground-engaging base 11 and a roof-engaging canopy or roof engaging support 12, a rear shield 13 and pivoting links 14. There are pair of hydraulic support legs 15 which act between the roof engaging support 12 and the base 11. The hydraulic cylinder roof support legs 15 may not normally experience repeated full extension and retraction when the roof support 10 is in place during mining operations. This exposes the surfaces of the hydraulic legs 15 to corrosive gases within the mine for long periods where the hydraulic cylinder legs 15 are not wiped with a hydraulic fluid to form any barrier against corrosion. Therefore, corrosion is likely to occur and does occur on the surfaces of bronze plated hydraulic cylinder legs or cylinders with other surface materials, especially in mines where hydrogen sulfide gas is present.

In FIG. 1, there is shown a nitrogen or other non-corrosive gas supply 16, a control valve 17, and a pressure reducing valve 18 which supplies low pressure nitrogen gas to an enclosure 19. Enclosure 19 is a flexible gas barrier which is attached to a lower cylinder and upper cylinder of a hydraulic cylinder by means of lower 32 and upper 30 flanges.

Figure 3:
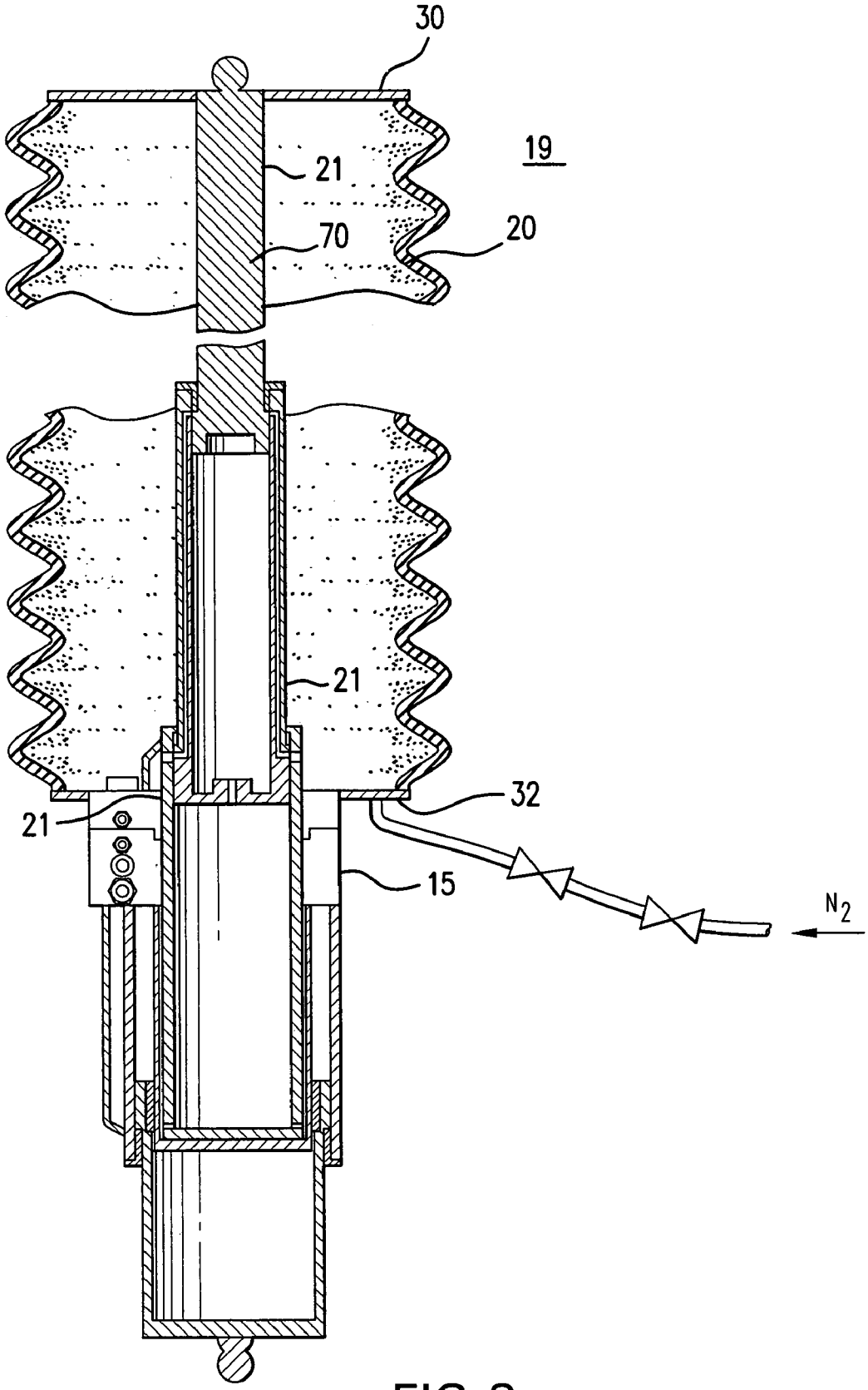
FIG. 3 shows a fully extended roof support with a gas enclosure and flanges shown in FIGS. 2B and 2D.
Figure 4:
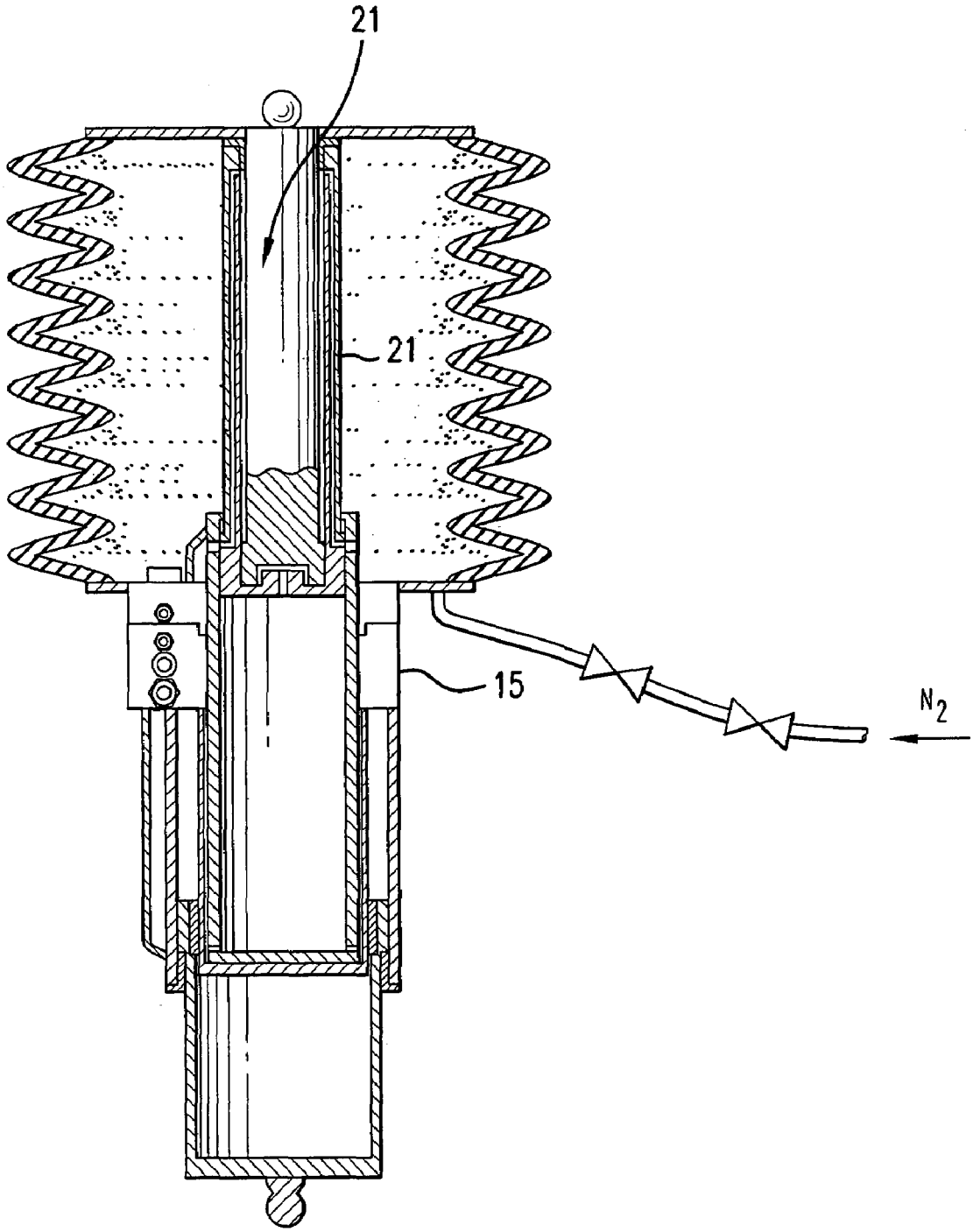
FIG. 4 shows a partially extended roof support cylinder with the enclosure partially collapsed.
Figure 5:
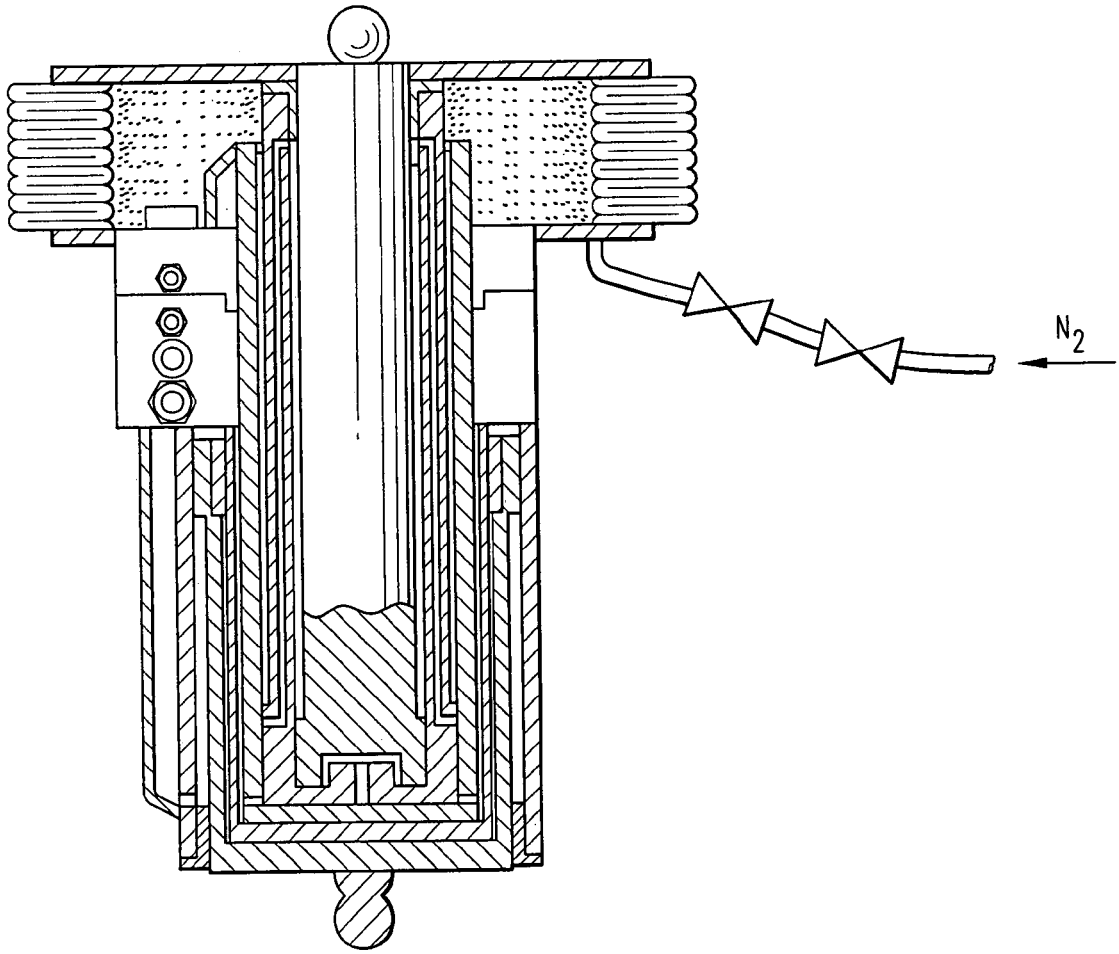
FIG. 5 shows a completely collapsed roof support cylinder with the enclosure fully collapsed.

As shown in FIG. 3, the enclosure 19 comprises a flexible plastic, rubber, or otherwise suitable enclosure member 20 which is placed around the hydraulic cylinder 21 of the hydraulic leg assembly 15. The leg assembly is fixed to the base 11 and the flexible enclosure 20 is attached at the lower and upper portions as shown in FIGS. 1, 3, 4 and 5. FIG. 4 shows the hydraulic leg partially collapsed, lowering the upper portion of the hydraulic cylinder 21, and FIG. 5 shows the hydraulic leg in a completely collapsed position with the plastic enclosure folded upon itself.

Figure 2A:
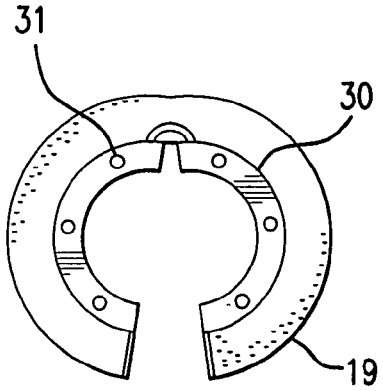
FIG. 2A shows an upper flange in an open position which can clamp around the top of a roof support cylinder.
Figure 2B:
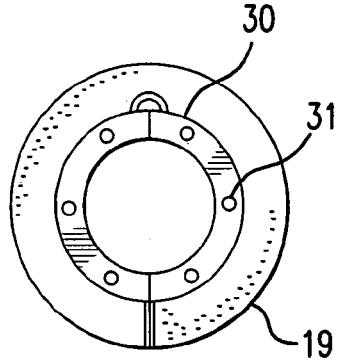
FIG. 2B shows an upper flange in a closed position.

In FIGS. 2A and 2B there is shown an upper flange 30 which forms an upper portion of enclosure 19. The upper flange 30 engages an upper portion of the hydraulic cylinder 21 of hydraulic leg 15. The flange is clamped around the upper portion of cylinder 21 and provides a means for attaching a plastic enclosure 20 at its periphery. In the flange 30, there is provided one or more pressure release orifices 31. The pressure release orifice is sized so that there will be a continuous exhaust flow of non-corrosive gas (nitrogen) during the period when gas is supplied to the enclosure 19. The size of orifice 31 is dependent upon the pressure and flow rate of the gas flowing into the enclosure which is controlled by valve 17.

Figure 2C:
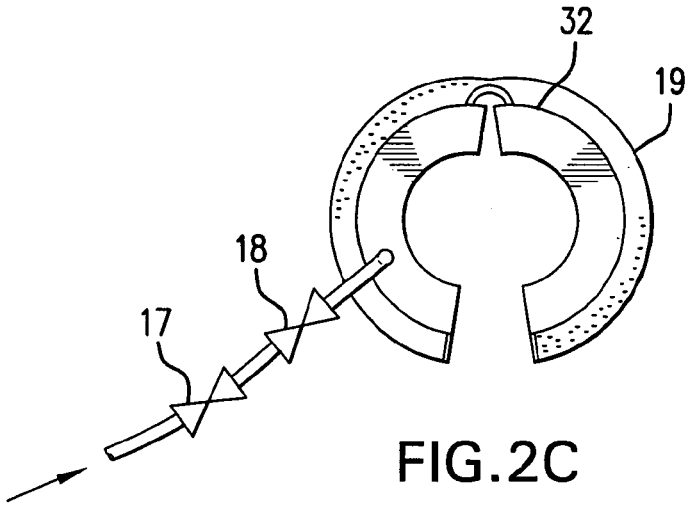
FIG. 2C shows a lower flange which can clamp around a bottom cylinder of a roof support cylinder with a nitrogen supply and valves shown schematically.
Figure 2D:
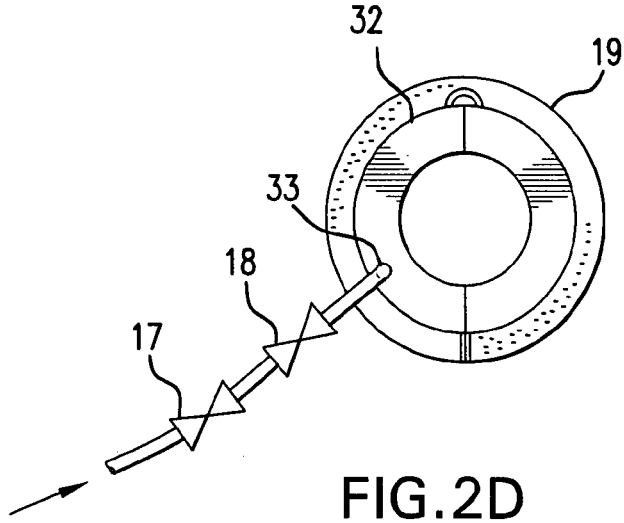
FIG. 2D shows a lower flange in a closed position with a nitrogen supply and valves shown schematically.

FIGS. 2C and 2D show a lower flange 32 which clamps around a bottom portion of the hydraulic leg 15 or hydraulic cylinder 21. The lower flange forms a bottom portion of enclosure 19. The lower flange is shown in an open position in FIG. 2C and in a closed position in FIG. 2D. Gas flows into the enclosure 19 through an opening 33 in the lower flange 32. Still further, in accordance with this invention, the upper flange and lower flange functions may be reversed, thereby placing a pressure release orifice on the lower flange and an inlet port or opening on the upper flange.

Non-corrosive gas is introduced into the enclosure at a pressure and flow rate that allows for suitable flushing against the variable pressure outside the enclosure. The flow rate is determined by the gas feed pressure, the pressure limits of the enclosure and its fastenings and the size and adjustment of the exhaust ports. The exhaust ports are shown as fixed orifices, however, they may have a variable or adjustable size and, along with the flow control valve, can be used to adjust the flow, maintaining a nominally positive pressure inside the enclosure compared to variable ambient conditions.

Nitrogen or other non-corrosive gas, which is otherwise available in certain coal mines having a methane gas concentration or spontaneous combustion of gob problem, or which may be available for the purpose of protecting the cylinders only, is fed to the enclosure 19 through a valve 17 which is a control valve for turning on and off the nitrogen supply. Valve 18 is a pressure reduction valve which reduces pressure to a low level, such as two or three inches water column, in order to provide a very slight positive pressure within the enclosure with respect to the mine ambient pressure. This pressure in the enclosure is controlled by sizing orifices 31 in the upper flange, as well as valves on the inlet and/or adjustable valves at the outlets. For example, an R400 Regulator manufactured by Maxitrol can be used to provide an outlet pressure of four inches water column at the lower flange. To provide a 100 cubic foot per hour flow rate with an exhaust velocity of 10 feet per second, a total area of 0.4 square inches for the exhaust ports can be used. Eight-quarter inch diameter holes will provide an appropriate size.

The enclosure 19 may be made of a flexible plastic material with a sealable longitudinal split which runs vertically along one side. This enables the enclosure, along with the upper flange 30 and the lower flange 32, to be wrapped around the hydraulic cylinder 21 without removal of the hydraulic cylinder 21 from the roof support assembly 10. This system and apparatus provides for protection against hydrogen sulfide corrosion or other corrosive agents of cylinders of the type disclosed herein without disassembly of the roof support 10. The upper and lower flanges 30 and 32 are clamped around the cylinder 15 and the longitudinal split is closed to complete the enclosure.

Hose clamps may be used as collars around the top and bottom of hydraulic roof support cylinders. The extensible enclosure is attached to flanges 30, 32 on each end or directly to cylinders with hose clamps or other clamping means. One flange shield is used to introduce the nitrogen or other non-corrosive gas into the enclosure and the other flange shield is used to support exhaust ports.

In a mine which uses nitrogen purge to reduce methane levels or oxygen levels in gob, the nitrogen becomes essentially free because the amount of nitrogen which bleeds from pressure release orifices 31 is very small when compared to that used to suppress spontaneous combustion.

This invention incorporates a plastic or other flexible enclosure sized to completely cover any particular metal surface or other article, with seals similar to Velcro, taped or zip lock seals to allow placement and removal of the enclosure and collared parts, allowing gas introduction and gas exhaust from the interior of the enclosure. For cylindrical objects (hydraulic cylinders), flange shields are used as collars on each end of the cylindrical object. The plastic or other suitable flexible enclosure is adhered to the flange shields on each end with a longitudinal seal on the plastic shielding enclosure and the flanges aligned. One flange shield is used to introduce nitrogen or other non-corrosive gas into the enclosure and the other flange is used to support exhaust ports.

The invention claimed is:

1. A roof support for an underground mine comprising in combination:

a roof engaging support;

a ground engaging base;

at least one hydraulic cylinder positioned between said roof engaging support and said ground engaging base;

a flexible gas barrier surrounding surfaces of said at least one hydraulic cylinder which are subject to corrosion by gases present in said underground mine; and a non-corrosive gas supply for supplying a non-corrosive gas to a space between said gas barrier and said at least one hydraulic cylinder.

2. A roof support for an underground mine in accordance with claim 1, wherein said non-corrosive gas is nitrogen.

3. A roof support for an underground mine in accordance with claim 1, further comprising a pressure release or exhaust orifice for creating and regulating a positive pressure within said gas barrier with respect to ambient pressure when said non-corrosive gas is supplied to said space.

4. A roof support for an underground mine in accordance with claim 3, wherein said pressure release or exhaust orifice is attached to a flange which is attached to said at least one hydraulic cylinder and said gas barrier.

5. A roof support for an underground mine in accordance with claim 1, wherein said gasses present in said underground mine which cause corrosion include hydrogen sulfide.

6. A roof support for an underground mine in accordance with claim 1, wherein said surfaces of said at least one hydraulic cylinder are plated with bronze.

7. A roof support for an underground mine in accordance with claim 1, wherein said non-corrosive gas is supplied from a nitrogen gas supply used to reduce the hazard of spontaneous combustion of coal in the mine.

8. A roof support for an underground mine in accordance with claim 1, wherein there are at least two hydraulic cylinders positioned between said roof engaging support and said ground engaging base.

9. A roof support for an underground mine in accordance with claim 1, wherein the surfaces of said at least one hydraulic cylinder which are subject to corrosion by gases present in said underground mine are outer surfaces of a lower cylinder and an upper cylinder of a two cylinder hydraulic cylinder.

10. A roof support for an underground mine in accordance with claim 1, wherein said gas barrier is attached to a lower cylinder and an upper cylinder of said at least one hydraulic cylinder.

* * * * *